US007300325B2

(12) United States Patent
Mizuguchi et al.

(10) Patent No.: US 7,300,325 B2
(45) Date of Patent: Nov. 27, 2007

(54) OUTBOARD MOTOR

(75) Inventors: Hiroshi Mizuguchi, Saitama (JP); Hiromi Ura, Saitama (JP); Hiroshi Takahashi, Saitama (JP); Koji Kasai, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 64 days.

(21) Appl. No.: 11/157,594

(22) Filed: Jun. 21, 2005

(65) Prior Publication Data

US 2005/0287885 A1 Dec. 29, 2005

(30) Foreign Application Priority Data

Jun. 25, 2004 (JP) ..... 2004-187214

(51) Int. Cl.
*B63H 1/15* (2006.01)

(52) U.S. Cl. ..... 440/52

(58) Field of Classification Search ..... 440/52
See application file for complete search history.

(56) References Cited

U.S. PATENT DOCUMENTS

| | | | | |
|---|---|---|---|---|
| 4,395,982 | A * | 8/1983 | Moller | 123/195 C |
| 4,583,953 | A * | 4/1986 | Nakase | 440/52 |
| 4,805,724 | A * | 2/1989 | Stoll et al. | 181/290 |
| 6,358,106 | B1 * | 3/2002 | Herrera | 440/77 |
| 6,875,066 | B2 * | 4/2005 | Wolaver | 440/77 |
| 2002/0134193 | A1 * | 9/2002 | Lawrence | 74/606 R |

FOREIGN PATENT DOCUMENTS

JP 09-207888 8/1997

* cited by examiner

*Primary Examiner*—Stephen Avila
(74) *Attorney, Agent, or Firm*—Carrier, Blackman & Associates, P.C.; William D Blackman; Joseph P. Carrier

(57) ABSTRACT

In an outboard motor, an extension case (member constituting a frame of the outboard motor) has the natural frequency (resonance frequency) of higher than the vibration frequency produced when the engine operates at maximum speed. Since this configuration prevents the extension case from resonating during operation of the outboard motor, noise (more specifically, noise produced by the outboard motor) propagated to the outside can be reduced.

10 Claims, 5 Drawing Sheets

PRIOR ART

OUTBOARD MOTOR

BACKGROUND OF THE INVENTION

1. Field of the Invention

This invention relates to an outboard motor, particularly to an outboard motor capable of reducing noise propagated to the outside.

2. Description of the Related Art

Existing techniques for reducing outboard motor noise include, for example, the technique taught by Japanese Laid-Open Patent Application No. Hei 9(1997)-207888 (paragraph 0012, FIG. 1 etc.), which prevents spreading of outboard motor noise by surrounding the outboard motor with a cover attached to the boat (hull).

However, the aforesaid prior art requires a cover separate of the outboard motor to be attached to the boat and, as such, not only causes an increase in the number of components and their weight but also requires space to be set aside on the boat for installation of the cover. The problem of outboard motor noise must therefore be solved not by preventing the noise from spreading but by reducing the noise that the outboard motor propagates to the outside, i.e., by reducing the noise generated by the outboard motor.

SUMMARY OF THE INVENTION

In light of the foregoing issues, an object of this invention is therefore to provide an outboard motor capable of reducing noise propagated to the outside.

In order to achieve the object, this invention provides an outboard motor adapted to be mounted on a stern of a boat and having an internal combustion engine and a propeller located below the engine in a gravitational direction to be powered to propel the boat, comprising: a member constituting a frame of the engine and having a natural frequency higher than a vibration frequency produced when the engine operates at a maximum speed.

BRIEF DESCRIPTION OF THE DRAWINGS

The above and other objects and advantages of the invention will be more apparent from the following description and drawings in which.

DETAILED DESCRIPTION OF THE PREFERRED EMBODIMENT

A preferred embodiment of the outboard motor according to the invention will now be explained with reference to the attached drawings.

Figure 1:
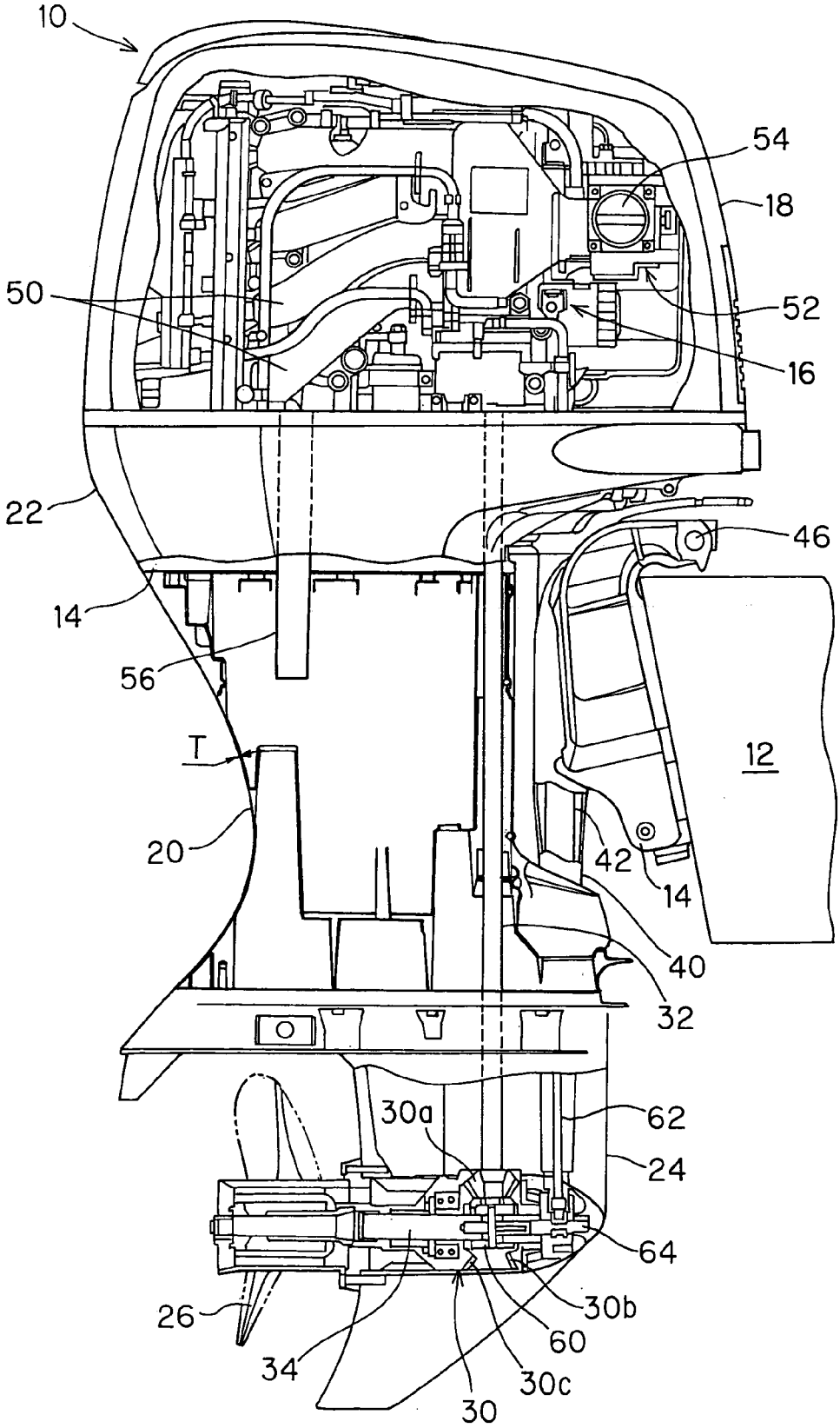
FIG. 1 is a side view of an outboard motor according to an embodiment of the invention.

FIG. 1 is a side view of an outboard motor according to an embodiment of the invention. The outboard motor is shown partly in section in the drawing.

Figure 2:
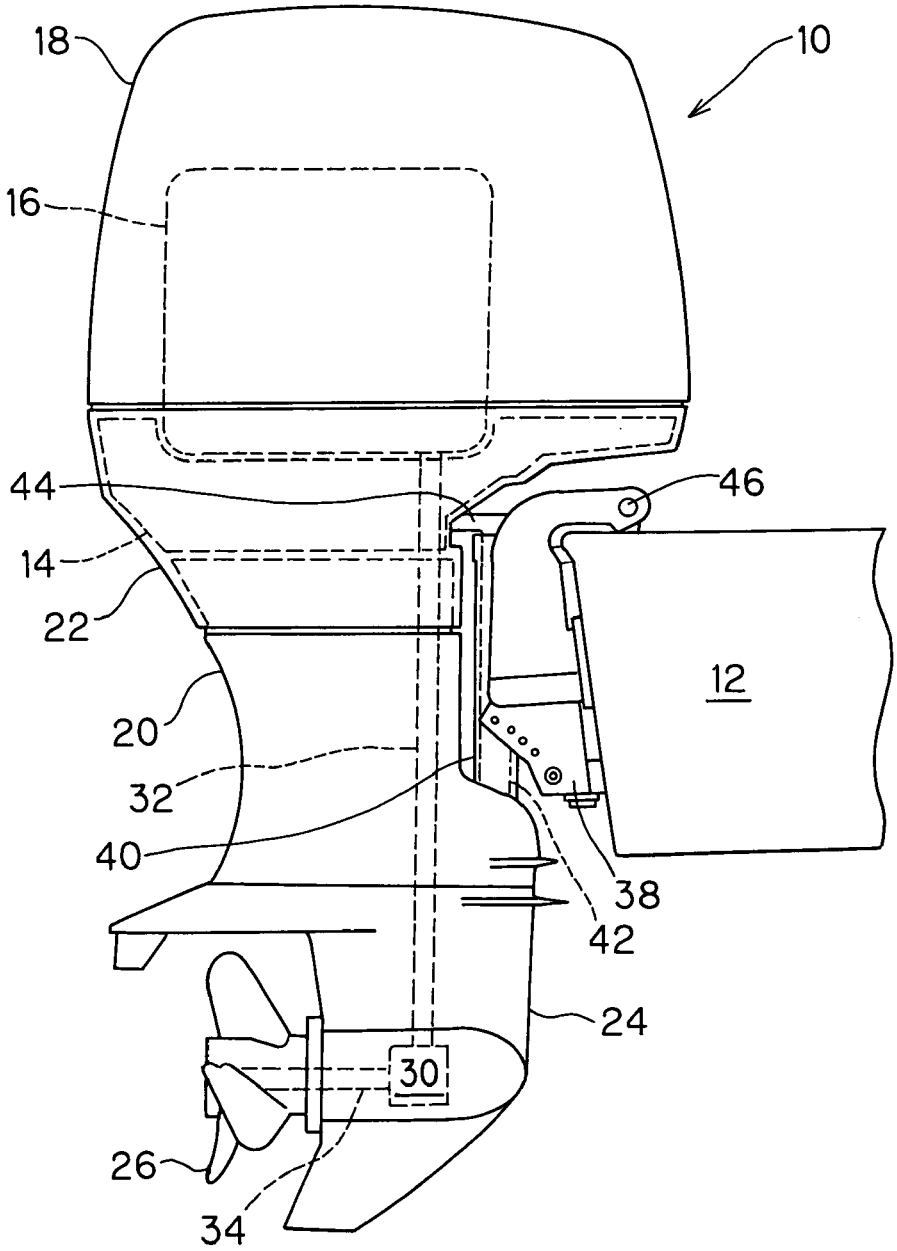
FIG. 2 is a simplified side view of the outboard motor shown in FIG. 1.

The explanation with reference to FIG. 1 will be made after a summary description of the structure of the outboard motor according to the invention is given with reference to FIG. 2. FIG. 2 is a simplified side view of the outboard motor according to the embodiment.

As shown in FIG. 2, the outboard motor, designated by reference numeral 10, is mounted on the stem of a hull (boat) 12. The outboard motor 10 is equipped with a mount case (a second frame) 14. An engine 16 is mounted on the mount case 14. The engine 16 is a spark-ignition, V-6, gasoline engine that is enclosed by an engine cover 18 and positioned above the water surface.

An extension case (a first frame) 20 is fastened to the bottom of the mount case 14 by bolts that are not visible in the drawing. The upper part of the extension case 20 and the mount case 14 are enclosed by an engine undercover 22.

A gear case 24 is fastened to the bottom of the extension case 20 by bolts that are not visible in the drawing. The gear case (a third frame) 24 houses a gear mechanism 30 and has a propeller 26 attached thereto. Thus the propeller 26 is located below the engine 16 in the gravitational direction.

The output of the engine 16 is transmitted through a drive shaft (vertical shaft) 32 to the gear mechanism 30 as rotation around a vertical axis, converted to rotation around a horizontal axis in the gear mechanism 30, and transmitted to the propeller 26 through a propeller shaft 34. The propeller 26 therefore rotates around a horizontal axis to generate thrust that drives the boat 12 fore or aft.

The outboard motor 10 is equipped with stem brackets 38 fastened to the stem of the boat 12, a swivel case 40 attached to the stem brackets 38, and a swivel shaft 42 housed in the swivel case 40.

The swivel shaft 42 is free to rotate inside the swivel case 40. Its upper end is fastened to the mount case 14 through a mount frame 44 and its lower end is fastened to the extension case 20. The swivel case 40 is rotatably attached to the stem brackets 38 through a tilting shaft 46. With respect to the boat 12, therefore, the outboard motor 10 can be steered laterally about the swivel shaft 42 as an axis of rotation and can also be tilted up and down about the tilting shaft 46 as another axis of rotation to adjust the trim up or down.

The frames of the outboard motor 10 explained in the foregoing include the mount case 14, extension case 20 and gear case 24, all of which are made of metal, namely, aluminum.

Based on the premise of the foregoing explanation, the outboard motor 10 will now be explained in detail with reference to FIG. 1.

As shown in FIG. 1, the engine 16 is connected through an intake manifold 50 to a throttle body 52. The throttle body 52 is connected to an air intake pipe (not shown) and has a throttle valve 54 installed therein. The throttle valve 54 can be opened and closed by the operator via a wire or other appropriate force transmitting means connected thereto and led to outside the engine cover 18.

Intake air drawn into the air intake pipe and regulated in flow rate by the throttle valve 54 in the throttle body 52 flows through the intake manifold 50 and is mixed with fuel injected from an injector (not shown) in the vicinity of intake valves, thereby producing an air-fuel mixture.

The air-fuel mixture drawn into a combustion chamber (not shown) of each cylinder of the engine 16 is ignited and burned, and the resulting exhaust gas passes through an exhaust valve and an exhaust manifold (neither shown), whereafter it is discharged from an exhaust pipe 56 into the interior of the extension case 20. The exhaust gas discharged into the interior of the extension case 20 further passes through the gear case 24 to be discharged to outside the outboard motor 10.

As illustrated, the extension case 20 is formed to decrease in diameter from both the upper and lower ends toward the middle in the gravitational direction.

One end (the upper end) of the drive shaft 32 is connected via a crankshaft (not shown) to the engine 16. As illustrated, the drive shaft 32 has its axis of rotation oriented in parallel with the vertical axis and passes through the interior of the mount case 14, extension case 20 and gear case 24.

The other (lower) end of the drive shaft 32 is connected to the gear mechanism 30 inside the gear case 24. The gear mechanism 30 comprises a pinion gear 30*a* provided at the lower end of the drive shaft 32, a forward bevel gear 30*b* that meshes with and rotates in the opposite direction from the pinion gear 30*a*, and a reverse bevel gear 30*c*.

A clutch 60 is installed between the forward bevel gear 30*b* and reverse bevel gear 30*c*. The clutch 60 is attached to a rotating shaft of the propeller 26, namely, a propeller shaft 34, so that both are rotatable about a horizontal axis. By manipulating a shift rod 62 to slide a shift slider 64, the clutch 60 can be brought into engagement with either the forward bevel gear 30*b* or the reverse bevel gear 30*c*. Therefore, when the shift rod 62 is manipulated to engage the clutch 60 with the forward bevel gear 30*b* or the reverse bevel gear 30*c*, the rotation of the drive shaft 32 is converted to rotation about the horizontal axis and transmitted to the propeller 26, so that the propeller 26 is rotated either in the direction for propelling the boat 12 forward or the direction for propelling it rearward.

What characterizes this invention is that the natural frequency (resonance frequency) of the extension case 20 located between the mount case 14 and gear case 24 is defined to be higher than the vibration frequency produced when the engine 16 operates at maximum speed.

Figure 3:
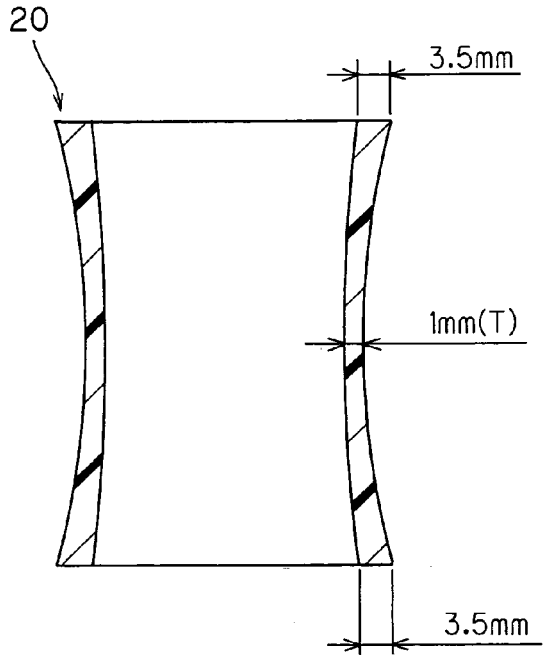
FIG. 3 is a diagrammatic illustration showing a sectional view of an extension case shown in FIG. 1.
Figure 4:
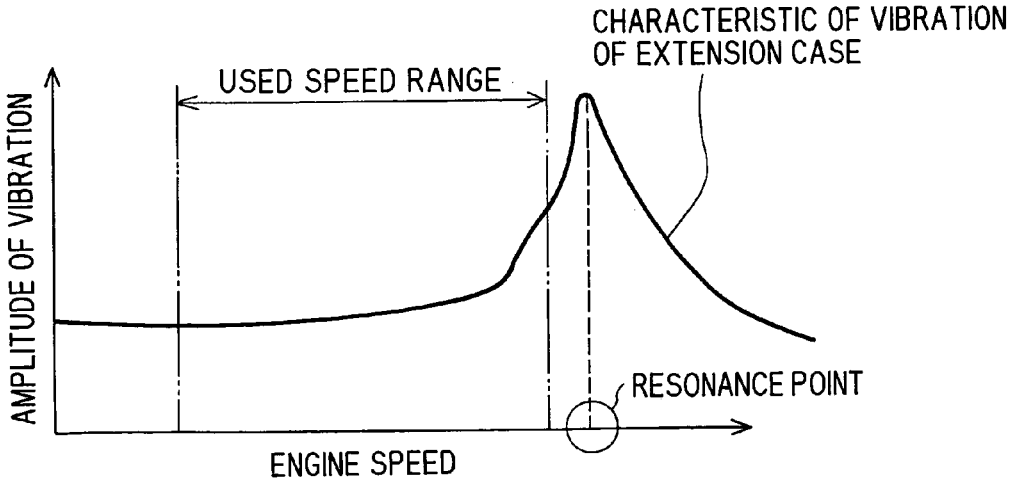
FIG. 4 is a curve showing the characteristics of the amplitude of vibration of the extension case relative to the speed of an engine shown in FIG. 1.

FIG. 3 is a diagrammatic illustration showing a sectional view of the extension case 20. FIG. 4 is a curve showing the characteristics of the amplitude of vibration of the extension case 20 relative to the speed of the engine 16.

In order to make the characterizing feature of this invention easier to understand, the extension case according to the prior art will be explained first.

Figure 5:
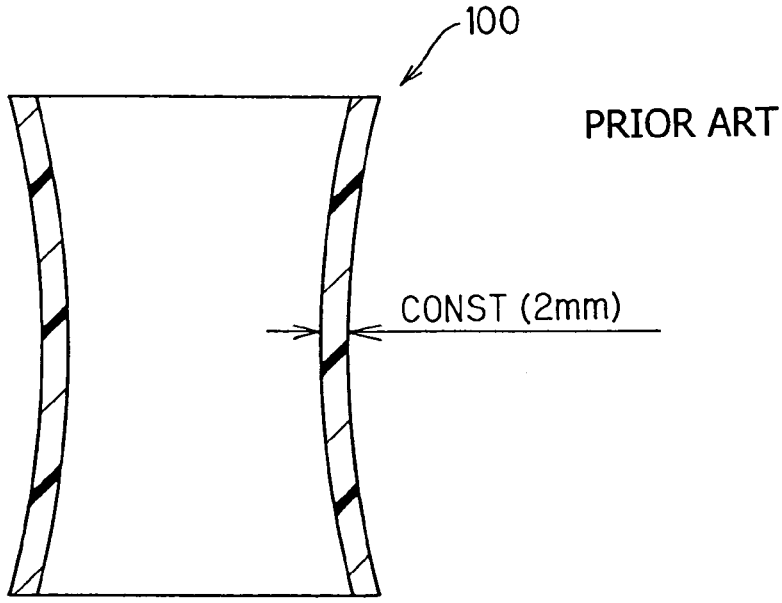
FIG. 5 is a diagrammatic illustration showing a sectional view of an extension case according to the prior art.

FIG. 5 is a diagrammatic illustration showing a sectional view of an extension case according to the prior art.

As shown in FIG. 5, the conventional extension case (designated 100) is formed to have a constant wall thickness (of 2 mm, for example) except at rib portions (not shown) and the like.

Figure 6:
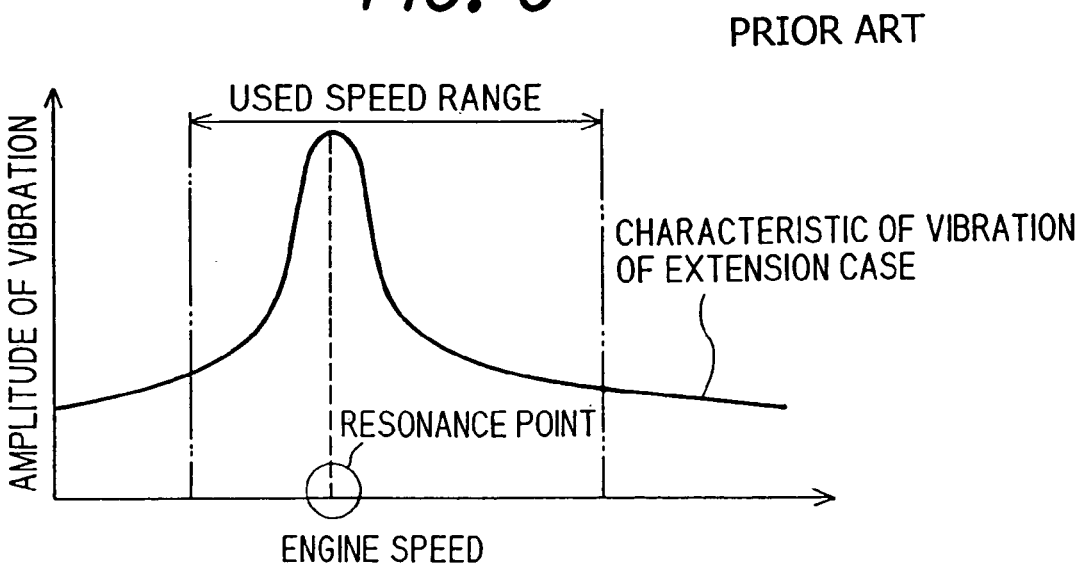
FIG. 6 is a curve showing the characteristics of the amplitude of vibration of the extension case shown in FIG. 5 relative to the engine speed.

FIG. 6 is a curve showing the characteristics of the amplitude of vibration of the extension case shown in FIG. 5 relative to the engine speed.

As can be seen in FIG. 6, the natural frequency of the conventional extension case sometimes coincides with a certain vibration frequency produced in the speed range used by the engine (e.g., around 1,000 to 6,000 rpm). Therefore, when the engine is operated at this particular speed, the extension case resonates to cause a marked increase in noise level.

In view of this problem, the inventors took note of the low-order vibration mode of the extension case and gave the part of the extension case where vibration is greatest (the vibration anti-node) an optimum wall thickness.

Figure 7:
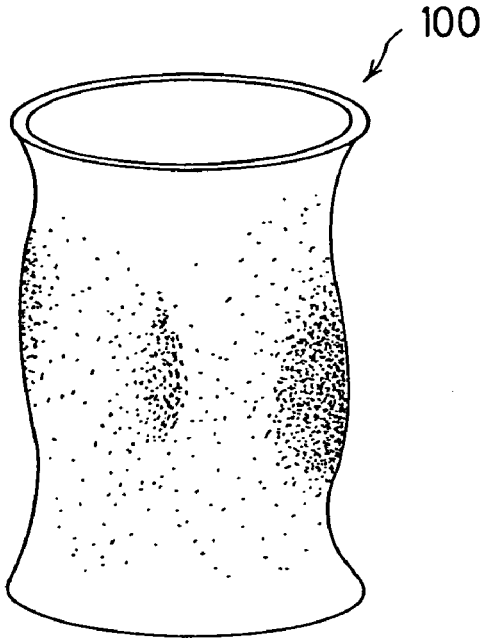
FIG. 7 is a low-order vibration mode diagram of the extension case shown in FIG. 5.

FIG. 7 is a low-order vibration mode diagram of the extension case 100 shown in FIG. 5. The drawing represents amplitude by dot density. That is to say, a region of higher amplitude is represented by higher dot density. As shown, the conventional extension case 100 was found to have the highest amplitude at the middle region in the gravitational direction.

In this invention, therefore, the middle of the extension case 20 in the gravitational direction is given a different wall thickness (designated T in FIG. 1) from the remaining regions.

Specifically, as shown in FIG. 3, the upper and lower ends of the extension case 20 are defined to have a wall thickness of 3.5 mm and the middle part thereof (where the wall is thinnest) is defined to have a wall thickness T equal to about 30% of 3.5 mm, namely, a thickness of 1 mm, and the thickness is gradually changed (reduced) from the upper and lower ends toward the middle.

Thus, the wall thickness at the middle of the extension case 20 is made smaller than that at the upper and lower ends and, more exactly, is made about 30% of the thickness at the upper and lower ends. As a result, the middle region of the extension case 20 is reduced in rigidity (but is still sufficiently rigid to ensure adequate strength) and lowered in weight, thereby raising the natural frequency of the extension case 20.

Therefore, as shown in FIG. 4, the natural frequency of the extension case 20 can be made higher than the vibration frequency produced by the engine 16 at maximum speed (around 6,000 rpm), whereby the extension case 20 can be prevented from resonating during operation of the outboard motor 10.

The natural frequencies of the extension cases of the invention and of the conventional art were measured. That of the conventional extension case formed to have a constant wall thickness of 2 mm was 1,500 Hz and that of the extension case of the invention was 1,650 Hz, i.e., 10% higher.

As set out in the foregoing, the outboard motor according to the embodiment is configured such that the extension case (member constituting a frame of the outboard motor 10) 20 has the natural frequency (resonance frequency) higher than the vibration frequency produced when the engine 16 operates at maximum speed. Since this configuration prevents the extension case 20 from resonating during operation of the outboard motor 10, noise (more specifically, noise produced by the outboard motor) propagated to the outside can be reduced.

In addition, the wall thickness T at the middle of the extension case 20 in the gravitational direction is made smaller than that at other regions (specifically, to be about 30% of the wall thickness at the upper and lower ends), thereby defining the natural frequency of the extension case 20 higher than the vibration frequency produced when the engine 16 operates at maximum speed, so that the aforesaid effect can be achieved without causing increased weight or cost.

Although in the foregoing explanation the extension case 20 was taken as an example of the member whose natural frequency is defined higher than the vibration frequency produced when the engine 16 operates at maximum speed, it is possible instead to define the natural frequency of another member constituting a frame, such as the mount case 14 or gear case 24, in this manner. Moreover, the invention can also be applied to the engine cover 18 and/or the engine undercover 22.

Although foregoing embodiment is configured so that the wall thickness T at the middle of the extension case 20 in the gravitational direction is about 30% of the wall thickness at other regions, the invention does not limit this ratio to 30%. Even though it depends on the shape and material of the extension case, it is possible, assuming an ordinary outboard motor, to raise the natural frequency, while still maintaining adequate strength, by defining the ratio in the approximate range of 30% to 60%.

Although in the foregoing explanation three members, i.e., the mount case 14, extension case 20 and gear case 24, were given as examples of frames of the outboard motor 10, these are merely examples and the invention can be applied even in cases where the frames differ from the foregoing in name, shape and number in accordance with the structure of the outboard motor.

As stated above, this embodiment is configured to have an outboard motor (10) adapted to be mounted on a stern of a boat (12) and having an internal combustion engine (16) and a propeller (26) located below the engine in a gravitational direction to be powered to propel the boat, comprising: a member (extension case 20) constituting a frame of the engine and having a natural frequency higher than a vibration frequency produced when the engine operates at a maximum speed.

In the outboard motor, the member comprises a first frame located between a second frame (mount case 14) on which the engine is mounted and a third frame (gear case 24) to which the propeller is attached.

In the outboard motor, a wall thickness (T) at a middle of the first frame in the gravitational direction is made smaller, more specifically, is made smaller by a ratio in a range of 30% to 60% than that at other regions of the first frame, such that the first frame has the natural frequency higher than the vibration frequency produced when the engine operates at a maximum speed.

In the outboard motor, the first frame comprises an extension case (20) fastened to the bottom of the second frame.

In the outboard motor, the second frame comprises a mount case (14).

In the outboard motor, the third frame comprises a gear case (24).

Japanese Patent Application No. 2004-187214 filed on Jun. 25, 2004, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An outboard motor adapted to be mounted on a stern of a boat and having an internal combustion engine and a propeller located below the engine in a gravitational direction to be powered to propel the boat, comprising:

a member constituting a frame of the engine and having a natural frequency higher than a vibration frequency produced when the engine operates at a maximum speed; and wherein said engine frame is structured to have the natural frequency higher than the vibration frequency produced when the engine operates at the maximum speed such that said engine frame is prevented from resonating during operation of the outboard motor.

2. The outboard motor according to claim 1, wherein the member comprises a first frame located between a second frame on which the engine is mounted and a third frame to which the propeller is attached.

3. An outboard motor adapted to be mounted on a stern of a boat and having an internal combustion engine and a propeller located below the engine in a gravitational direction to be powered to propel the boat, said outboard motor comprising:

a member constituting a frame of the engine and having a natural frequency higher than a vibration frequency produced when the engine operates at a maximum speed;

wherein the member comprises a first frame located between a second frame on which the engine is mounted and a third frame to which the propeller is attached; and wherein a wall thickness at a middle of the first frame in the gravitational direction is made smaller than that at other regions of the first frame, such that the first frame has the natural frequency higher than the vibration frequency produced when the engine operates at a maximum speed.

4. The outboard motor according to claim 3, wherein the wall thickness at the middle of the first frame in the gravitational direction is made smaller by a ratio in a range of 30% to 60% than that at other regions of the first frame.

5. An outboard motor adapted to be mounted on a stern of a boat and having an internal combustion engine and a propeller located below the engine in a gravitational direction to be powered to propel the boat, said outboard motor comprising:

a member constituting a frame of the engine and having a natural frequency higher than a vibration frequency produced when the engine operates at a maximum speed;

wherein the member comprises a first frame located between a second frame on which the engine is mounted and a third frame to which the propeller is attached; and wherein the first frame comprises an extension case fastened to the bottom of the second frame.

6. The outboard motor according to claim 5, wherein the second frame comprises a mount case.

7. The outboard motor according to claim 2, wherein the third frame comprises a gear case.

8. The outboard motor according to claim 1, wherein said frame of the engine has a non-uniform thickness.

9. The outboard motor according to claim 1, wherein said frame of the engine is formed of metal.

10. The outboard motor according to claim 1, wherein said frame of the engine has a non-uniform wall thickness.

* * * * *